US011614709B1

(12) United States Patent
Tomioka et al.

(10) Patent No.: US 11,614,709 B1
(45) Date of Patent: Mar. 28, 2023

(54) ACCOMMODATING DEVICE AND IMAGE FORMING APPARATUS

(71) Applicant: FUJIFILM Business Innovation Corp., Tokyo (JP)

(72) Inventors: Kota Tomioka, Kanagawa (JP); Hiroyuki Tanaka, Kanagawa (JP); Yoichi Yamakawa, Kanagawa (JP); Shinya Hasegawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/743,462

(22) Filed: May 13, 2022

(30) Foreign Application Priority Data

Nov. 19, 2021 (JP) ..... JP2021-188951

(51) Int. Cl.
*G03G 21/16* (2006.01)

(52) U.S. Cl.
CPC ..... *G03G 21/1695* (2013.01); *G03G 21/1638* (2013.01); *G03G 2215/00383* (2013.01); *G03G 2215/00388* (2013.01)

(58) Field of Classification Search
CPC ..... G03G 21/1638; G03G 21/1695; G03G 2215/00383; G03G 2215/00388
See application file for complete search history.

(56) References Cited

U.S. PATENT DOCUMENTS

2007/0086819 A1* 4/2007 Park ..... G03G 15/6502 399/393
2014/0099150 A1* 4/2014 Matsumoto ..... B41J 13/08 400/619
2015/0168906 A1* 6/2015 Ishii ..... G03G 15/502 399/21

FOREIGN PATENT DOCUMENTS

JP 2003312870 11/2003

* cited by examiner

*Primary Examiner* — Joseph S Wong
(74) *Attorney, Agent, or Firm* — JCIPRNET

(57) ABSTRACT

An accommodating device includes a device body, an accommodating unit that accommodates a medium in the device body, and an expanding and contracting member that expands and contracts to connect the accommodating unit to the device body so as to be pulled out and has a part fixed to the accommodating unit on an inner side with respect to a side surface of the accommodating unit in an intersecting direction with a pulling direction of the accommodating unit and on a lower side of the accommodating unit in a vertical direction.

20 Claims, 9 Drawing Sheets

ACCOMMODATING DEVICE AND IMAGE FORMING APPARATUS

CROSS-REFERENCE TO RELATED APPLICATIONS

This application is based on and claims priority under 35 USC 119 from Japanese Patent Application No. 2021-188951 filed Nov. 19, 2021.

BACKGROUND

(i) Technical Field

The present invention relates to an accommodating device and an image forming apparatus.

(ii) Related Art

JP2003-312870A describes a configuration where a cassette portion of a paper feeding device is diagonally disposed, a cassette (for example, A3) in a maximum size is diagonally placed, and smaller cassettes are placed above and below the cassette.

SUMMARY

Aspects of non-limiting embodiments of the present disclosure relate to an accommodating device and an image forming apparatus that a user can supply a medium to an accommodating unit and a space where the accommodating unit including an expanding and contracting member is arranged is decreased compared to a case where expanding and contracting members are attached on both sides of the accommodating unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present invention, there is provided an accommodating device including a device body, an accommodating unit that accommodates a medium in the device body, and an expanding and contracting member that expands and contracts to connect the accommodating unit to the device body so as to be pulled out and has a part fixed to the accommodating unit on an inner side with respect to a side surface of the accommodating unit in an intersecting direction with a pulling direction of the accommodating unit and on a lower side of the accommodating unit in a vertical direction.

BRIEF DESCRIPTION OF THE DRAWINGS

Exemplary embodiment(s) of the present invention will be described in detail based on the following figures, wherein.

DETAILED DESCRIPTION

Examples of an accommodating device and an image forming apparatus according to an exemplary embodiment of the present invention will be described with reference to FIGS. 1 to 9. An arrow H shown in each drawing indicates an apparatus up-down direction, which is a vertical direction, an arrow D indicates an apparatus depth direction, which is a horizontal direction, and an arrow W indicates an apparatus width direction, which is a horizontal direction.

Overall Configuration of Image Forming Apparatus 10

Figure 1:
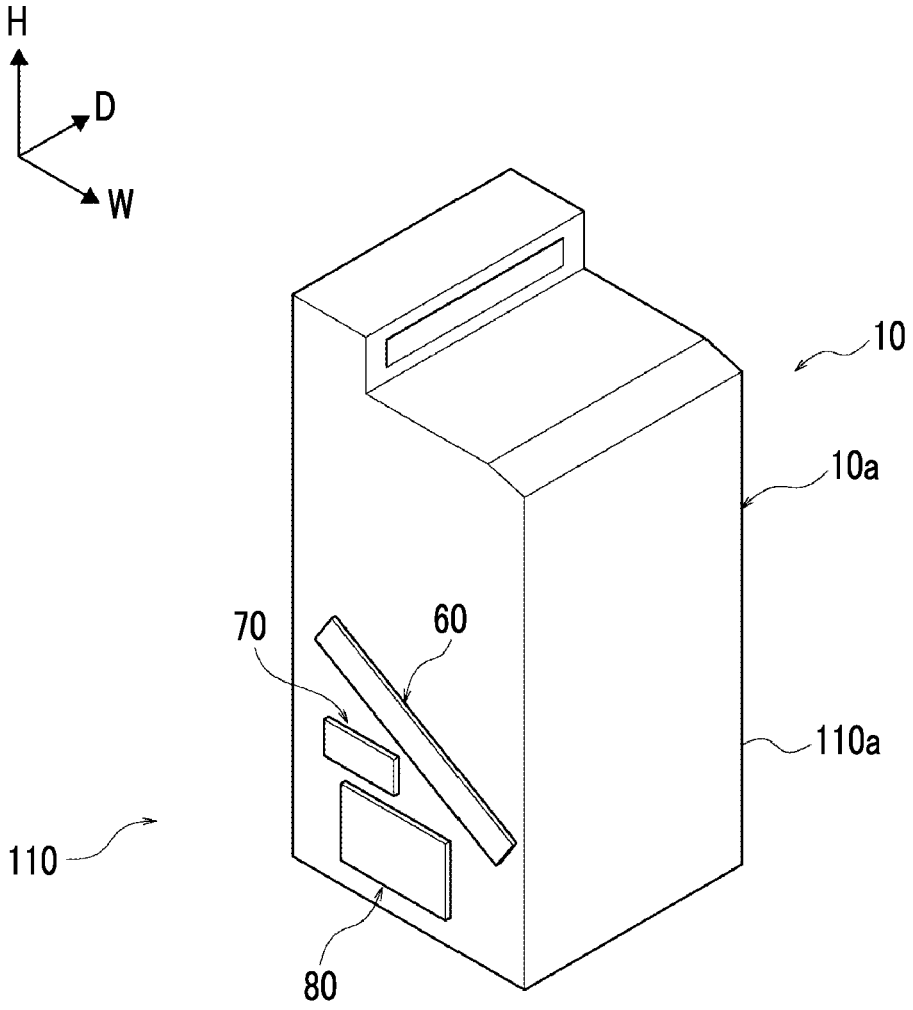
FIG. 1 is a perspective view showing an image forming apparatus according to an exemplary embodiment of the present invention.
Figure 2:
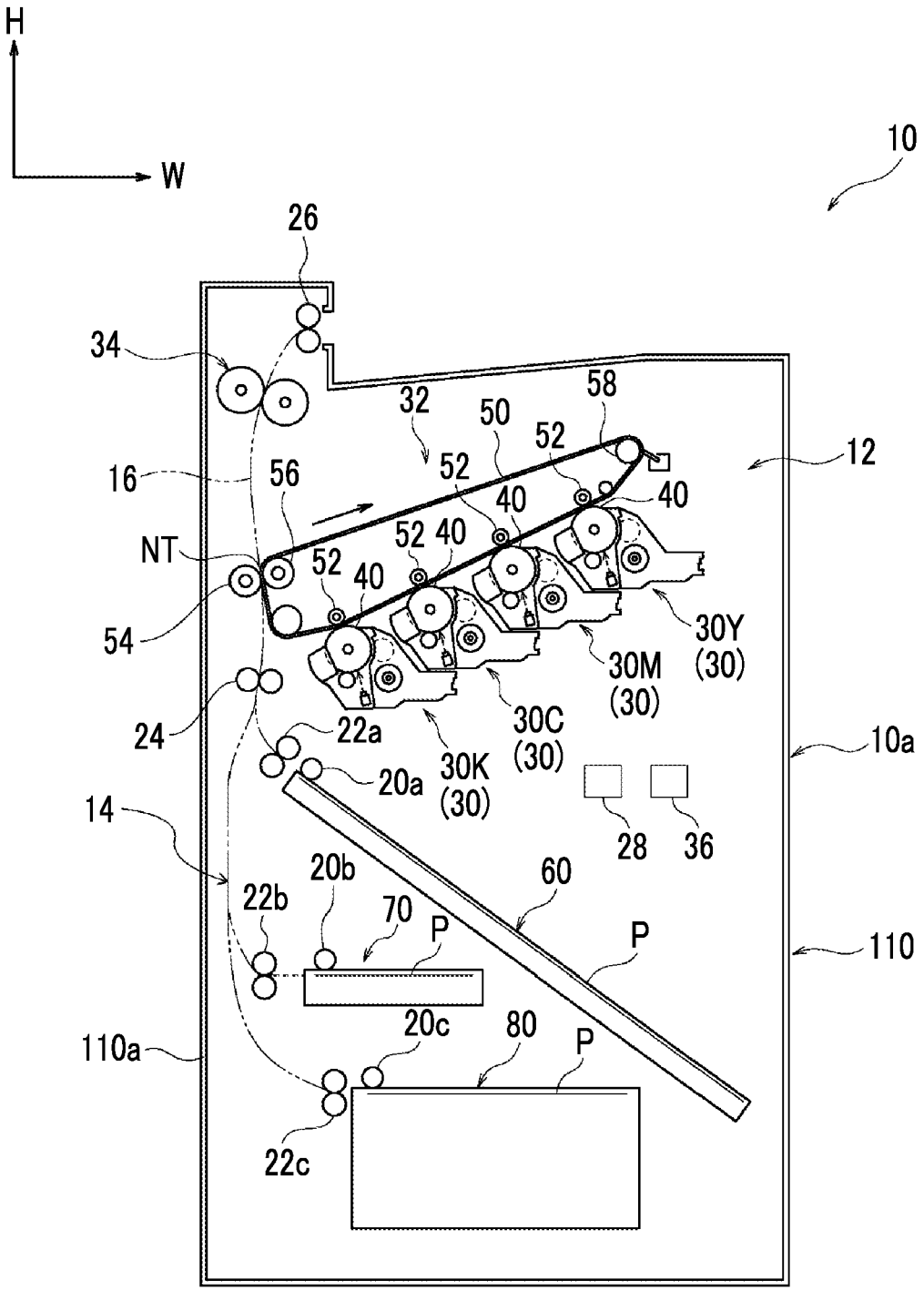
FIG. 2 is a schematic configuration view showing the image forming apparatus according to the exemplary embodiment of the present invention.

As shown in FIGS. 1 and 2, the image forming apparatus 10 includes an image forming unit 12 that forms a toner image through an electrophotographic method and an accommodating device 110 that has accommodating units 60, 70, and 80, which accommodate a transporting unit 14 transporting a medium P along a transport path 16 and the medium P. Further, the image forming apparatus 10 includes a control unit 28 that controls each unit and a main power supply 36 that supplies electric power of a commercial main power supply to each unit.

In the image forming apparatus 10 having the configuration, the medium P is accommodated by the accommodating units 60, 70, and 80, and the medium P accommodated in any one of the accommodating units 60, 70, and 80 is transported along the transport path 16 by the transporting unit 14. Further, a toner image formed by the image forming unit 12 is formed on the transported medium P, and the medium P on which the toner image is formed is discharged to the outside of an apparatus body 10*a*.

Image Forming Unit 12

As shown in FIG. 2, the image forming unit 12 includes a plurality of toner image forming units 30 that form respective colors of toner images and a transfer unit 32 that transfers the toner images formed by the toner image forming units 30 to the medium P. Further, the image forming unit 12 includes a fixing device 34 that fixes the toner images, which are transferred to the medium P by the transfer unit 32, to the medium P.

Toner Image Forming Unit 30

The plurality of toner image forming units 30 are included to form a toner image for each color. In the present exemplary embodiment, in total, four colors of yellow (Y), magenta (M), cyan (C), and black (K) toner image forming units 30 are provided. In the following description, in a case where it is not necessary to distinguish between yellow (Y), magenta (M), cyan (C), and black (K), Y, M, C, and K attached to the reference numerals are omitted.

Figure 3:
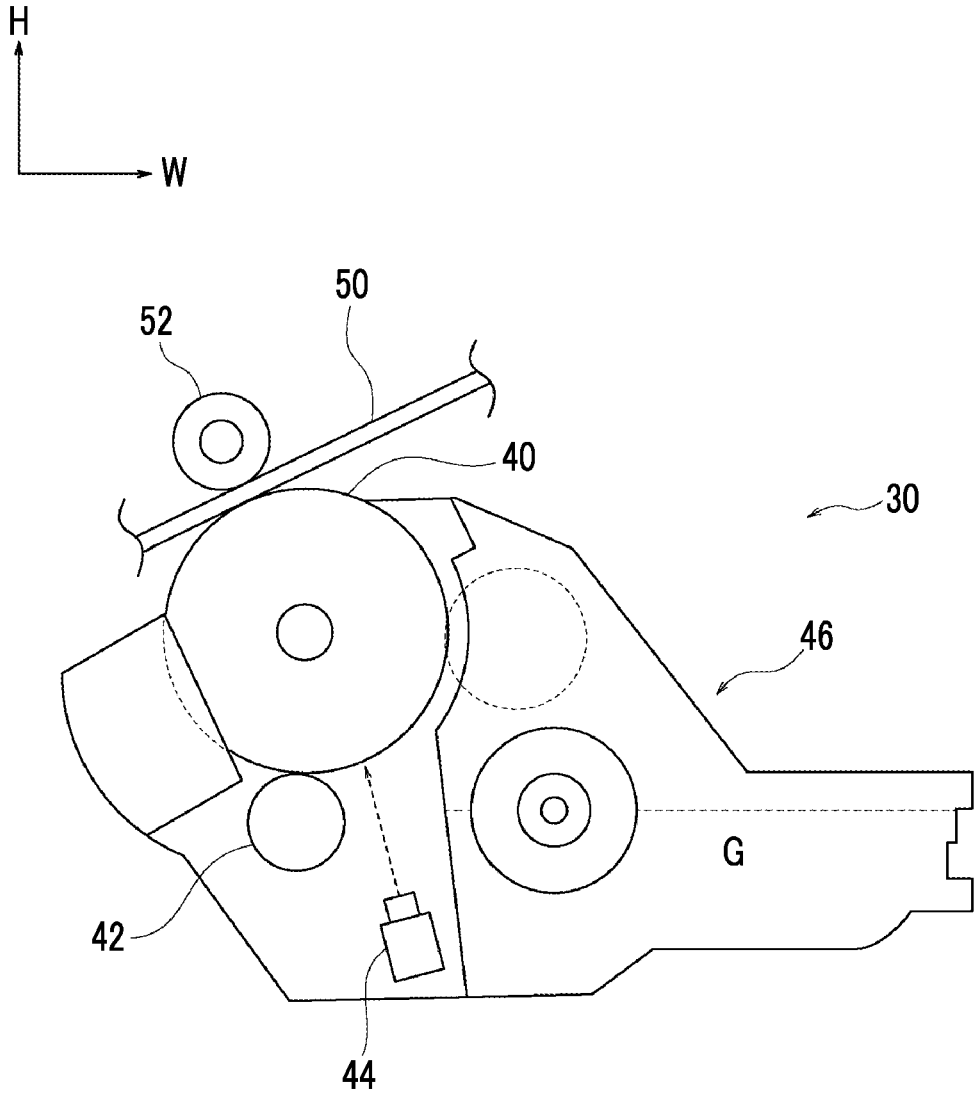
FIG. 3 is a configuration view showing an image forming unit of the image forming apparatus according to the exemplary embodiment of the present invention.

As shown in FIG. 3, the toner image forming unit 30 having each color is basically configured the same except for a toner to be used and includes a rotating cylindrical image holding body 40 and a charger 42 that charges the image holding body 40. Further, the toner image forming unit 30 includes an exposure device 44 that irradiates the charged image holding body 40 with exposure light and forms an electrostatic latent image and a developing device 46 that develops the electrostatic latent image with a developer G containing a toner as a toner image. Accordingly, the toner image forming unit 30 having each color forms an image having each color using each color of toner.

In addition, as shown in FIG. 2, the image holding body 40 having each color is in contact with a transfer belt 50 (details to be described later) that moves around. In a circumferential direction (see an arrow in FIG. 2) of the transfer belt 50, the yellow (Y), magenta (M), cyan (C), and black (K) toner image forming units 30 are arranged side by side in turn from an upstream side.

Transfer Unit 32

As shown in FIG. 2, the transfer unit 32 includes the transfer belt 50 and primary transfer rollers 52 each of which is arranged on an opposite side of the image holding body 40 having each color with the transfer belt 50 sandwiched therebetween and transfers a toner image formed on the image holding body 40 having each color to the transfer belt 50.

In addition, the transfer unit 32 includes a winding roller 56 around which the transfer belt 50 is wound and a drive roller 58 around which the transfer belt 50 is wound and which transmits a rotational force to the transfer belt 50. Accordingly, the transfer belt 50 moves around in an arrow direction in FIG. 2.

Further, the transfer unit 32 includes a secondary transfer roller 54 that is arranged on the opposite side of the winding roller 56 with the transfer belt 50 sandwiched therebetween and that transfers a toner image transferred to the transfer belt 50 to the medium P. A transfer nip NT where the toner image is transferred to the medium P is formed between the secondary transfer roller 54 and the transfer belt 50.

In the configuration, in order of yellow (Y), magenta (M), cyan (C), and black (K), the toner image is primarily transferred to the transfer belt 50 by the primary transfer roller 52. On the other hand, the toner image is transferred by the secondary transfer roller 54 from the transfer belt to the medium P transported while being sandwiched between the transfer belt 50 and the secondary transfer roller 54. Further, the medium P to which the toner image is transferred is transported toward the fixing device 34.

Fixing Device 34

As shown in FIG. 2, the fixing device 34 is arranged on a downstream side of the transfer nip NT in a transport direction of the medium P. The fixing device 34 heats and pressurizes the toner image transferred to the medium P and fixes the toner image to the medium P.

Accommodating Device 110

As shown in FIG. 2, the accommodating device 110 includes the three accommodating units 60, 70, and 80 that are arranged at a lower portion of the image forming apparatus 10 and accommodate the medium P and the transporting unit 14 that transports the medium P. The accommodating unit 60 arranged at the uppermost is inclined with respect to the horizontal direction. Details of the accommodating device 110 will be described later.

Control Unit 28 and Main Power Supply 36

The control unit 28 and the main power supply 36 are arranged in a triangular region formed between the inclined accommodating unit 60 and the image forming unit 12.

Major Portion Configuration

Next, the accommodating device 110 will be described. As shown in FIGS. 1 and 2, the accommodating device 110 is arranged at the lower portion of the image forming apparatus 10. A device body 110*a* of the accommodating device 110 is formed integrally with the apparatus body 10*a* of the image forming apparatus 10.

Figure 4:
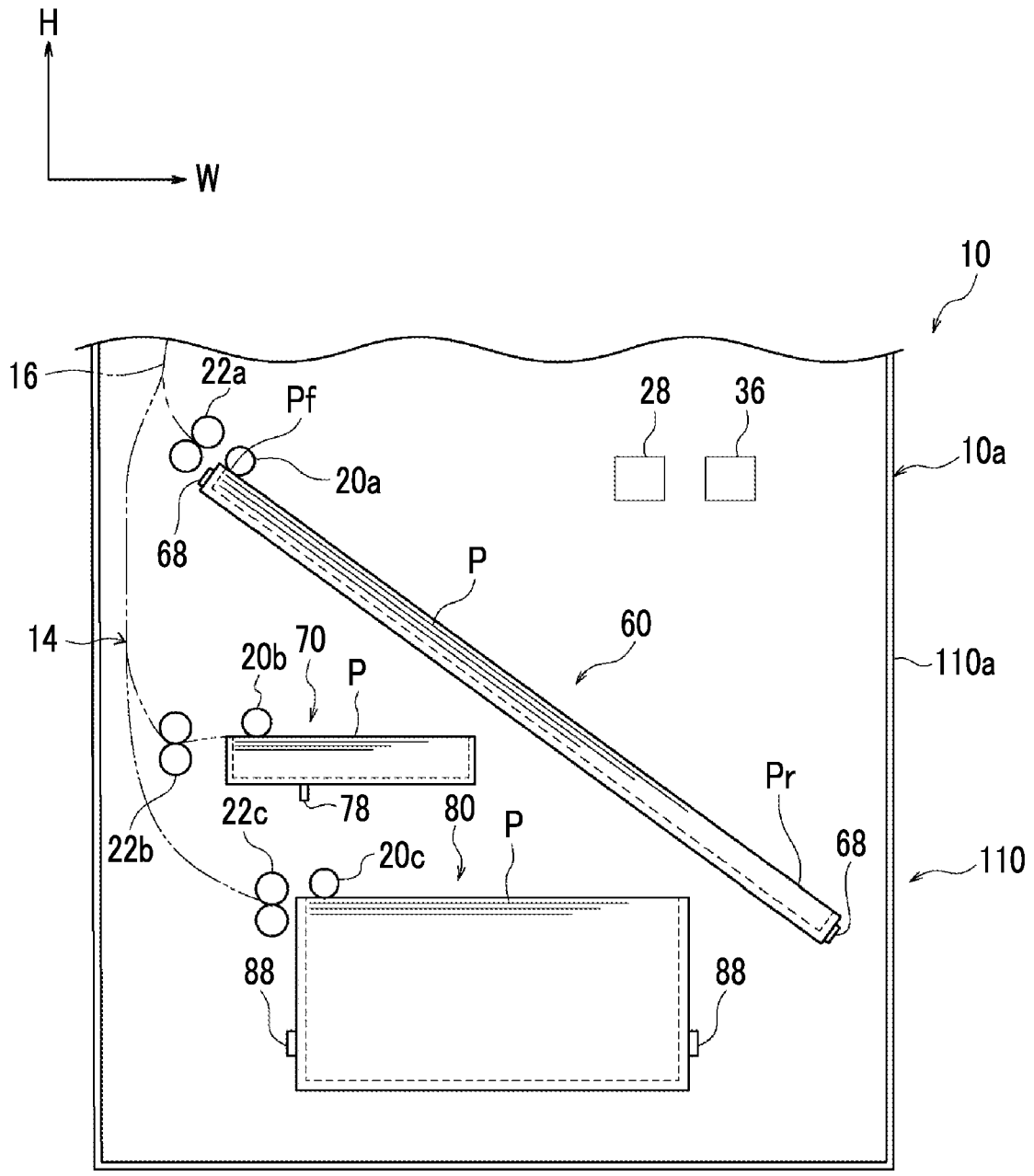
FIG. 4 is a configuration view showing an accommodating device according to the exemplary embodiment of the present invention.

As shown in FIG. 4, the accommodating device 110 includes the device body 110*a*, the accommodating unit 60 that accommodates the medium P, the accommodating unit 70 that accommodates the medium P, and the accommodating unit that accommodates the medium P. In addition, the accommodating device 110 includes a slide rail 68 that makes the accommodating unit 60 capable of moving in the apparatus depth direction D, a slide rail 78 that makes the accommodating unit 70 capable of moving in the apparatus depth direction D, and a slide rail 88 that makes the accommodating unit 80 capable of moving in the apparatus depth direction D. The accommodating unit 60, the accommodating unit 70, and the accommodating unit 80 are arranged from an upper side to a lower side in this order.

In the present exemplary embodiment, for example, the accommodating unit 60 generally accommodates the A3 medium P, and the A3 medium P is the medium P in the maximum size that can be accommodated in the accommodating unit 60. In addition, the accommodating unit 70 generally accommodates the postcard-sized medium P, and the postcard-sized medium P is the medium P in the maximum size that can be accommodated in the accommodating unit 70. The accommodating unit 80 generally accommodates the A4 medium P, and the A4 medium P is the medium P in the maximum size that can be accommodated in the accommodating unit 80.

In addition, in the present exemplary embodiment, for example, the accommodating unit 60 can accommodate 200 media P, the accommodating unit 70 can accommodate 100 media P, and the accommodating unit 80 can accommodate 1,000 media P. In the image forming apparatus 10, it is assumed that the consumption of the A4 medium P is the largest. That is, the number of sheets that can be accommodated in the accommodating unit 80 accommodating the media P of which the consumption is the largest is larger than the number of sheets that can be accommodated in the accommodating unit 60 and the number of sheets that can be accommodated in the accommodating unit 70.

Transporting Unit 14

As shown in FIG. 2, the transporting unit 14 includes a feeding roller 20*a* that feeds the medium P accommodated in the accommodating unit 60 to the transport path 16 and a prevention roller 22*a* that prevents double-feeding of the media P fed by the feeding roller 20*a*.

In addition, the transporting unit 14 includes a feeding roller 20*b* that feeds the medium P accommodated in the accommodating unit 70 to the transport path 16 and a prevention roller 22*b* that prevents double-feeding of the media P fed by the feeding roller 20*b*.

Further, the transporting unit 14 includes a feeding roller 20*c* that feeds the medium P accommodated in the accommodating unit 80 to the transport path 16 and a prevention roller 22*c* that prevents double-feeding of the media P fed by the feeding roller 20*c*.

In addition, the transporting unit 14 includes an adjusting roller 24 that is arranged on the downstream side of the prevention rollers 22*a*, 22*b*, and 22*c* in the transport direction of the medium P and that adjusts a timing when the medium P is fed to the transfer nip NT. Further, the transporting unit 14 includes a discharge roller 26 that discharges the medium P to which a toner image is fixed by the fixing device 34 to the outside of the apparatus body 10*a*.

Accommodating Unit 60 and Slide Rail 68

As shown in FIG. 4, the accommodating unit 60 has a box shape of which an upper side is open and accommodates a medium in the device body 110*a*. The accommodating unit 60 is another accommodating unit in the technique of the present invention. A pair of slide rails 68 are attached to both ends of the accommodating unit 60 in the apparatus width direction W respectively. The slide rail 68 includes an outer member, an intermediate member, and an inner member, the outer member is attached to the device body 110*a*, and the inner member is attached to the accommodating unit 60.

Accordingly, in a case where a user pulls out the accommodating unit 60 mounted on the device body 110*a* to a front side in the apparatus depth direction D, the accommodating unit 60 is guided by the slide rail 68 and is detached from the device body 110*a*. In addition, in a case where the user pushes in the accommodating unit 60 detached from the device body 110*a* to a back side in the apparatus depth direction D, the accommodating unit 60 is guided by the slide rail 68 and is mounted on the device body 110*a*.

In addition, as shown in FIG. 4, the accommodating unit 60 is inclined with respect to the horizontal direction such that vertical positions of one end (end portion on the left in FIG. 4) and the other end in the apparatus width direction are different from each other in a case of being viewed from the apparatus depth direction D in a state of being mounted on the device body 110*a* and a state of being detached from the device body 110*a*. Specifically, the accommodating unit 60 is inclined with respect to the horizontal direction such that the one end in the apparatus width direction is above the other end in a case of being viewed from the apparatus depth direction D. Herein, the one end and the other end are parts of the accommodating unit 60 and are one and the other of two points separated the most in the apparatus width direction.

In a state where the accommodating unit 60 is mounted on the device body 110*a*, the medium P accommodated in the accommodating unit 60 can be transported by the transporting unit 14. In other words, the accommodating unit 60 mounted on the device body 110*a* is located at a transport position where the accommodated medium P can be transported.

On the other hand, in a case where the user pulls out the accommodating unit 60 mounted on the device body 110*a* to the front side in the apparatus depth direction D, the accommodating unit 60 is guided by the slide rail 68, is abutted against a stopper (not shown) so as to be stopped, and is detached from the device body 110*a*. In addition, in a case where the user pushes in the accommodating unit 60 detached from the device body 110*a* to the back side in the apparatus depth direction D, the accommodating unit 60 is guided by the slide rail 68 and is mounted on the device body 110*a*. The detachment is a state where the medium P can be accommodated in the accommodating unit 60. In the present exemplary embodiment, a state where the accommodating unit 60 is detached from the device body 110*a* is a state where the accommodating unit 60 is not removed from the device body 110*a* and is supported by the device body 110*a* and is a state where the medium P can be accommodated in the accommodating unit 60.

Then, in a state where the accommodating unit 60 is detached from the device body 110*a*, an upper side of the accommodating unit 60 is opened, and the medium P can be supplied to the accommodating unit 60. In other words, the accommodating unit 60 detached from the device body 110*a* is located at a supply position where the medium P can be supplied to the accommodating unit 60.

Accommodating Unit 70 and Slide Rail 78

As shown in FIGS. 4 to 8, the accommodating unit 70 has a box shape of which an upper side is open and accommodates the medium P in the device body 110*a*. The accommodating unit 70 is an accommodating unit in the technique of the present invention. One slide rail 78 is fixed to a lower side of the accommodating unit 70.

In the present exemplary embodiment, the apparatus depth direction D and a pulling direction B of the accommodating unit 70 are parallel to each other, a pulling direction B side in the apparatus depth direction D will be defined as an apparatus front side, and an opposite side to the pulling direction B in the apparatus depth direction D will be defined as an apparatus back side. In addition, the apparatus width direction W corresponds to an intersecting direction in the technique of the present invention. In the present exemplary embodiment, the fact that the apparatus depth direction D and the pulling direction B of the accommodating unit 70 are parallel to each other may mean that both are practically parallel to each other, and an angle difference between both directions is in a state of allowing an error of approximately ±5°.

Figure 5:
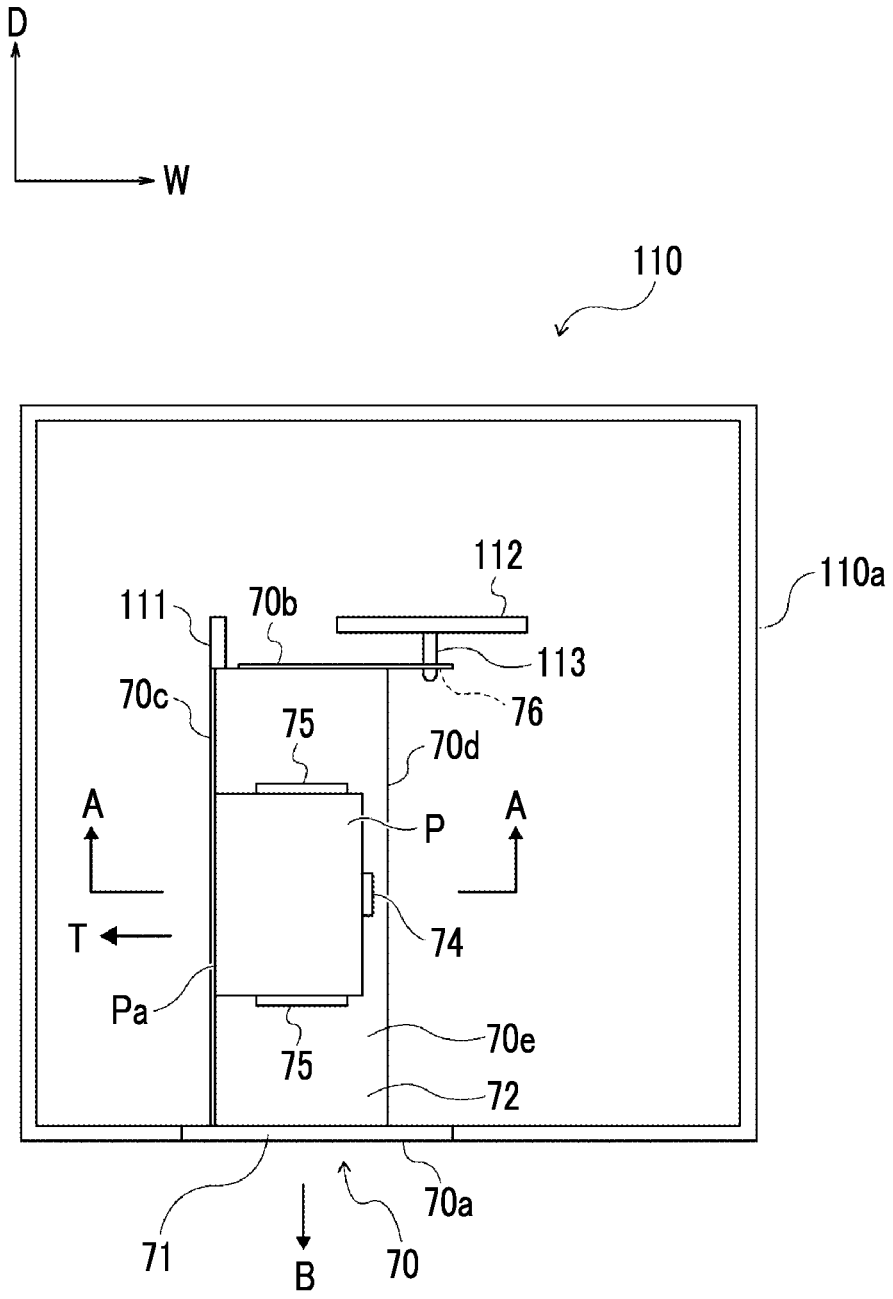
FIG. 5 is a schematic configuration view of an accommodating unit of the accommodating device according to the exemplary embodiment of the present invention and is a view showing a state where the accommodating unit is mounted on the accommodating device.
Figure 6:
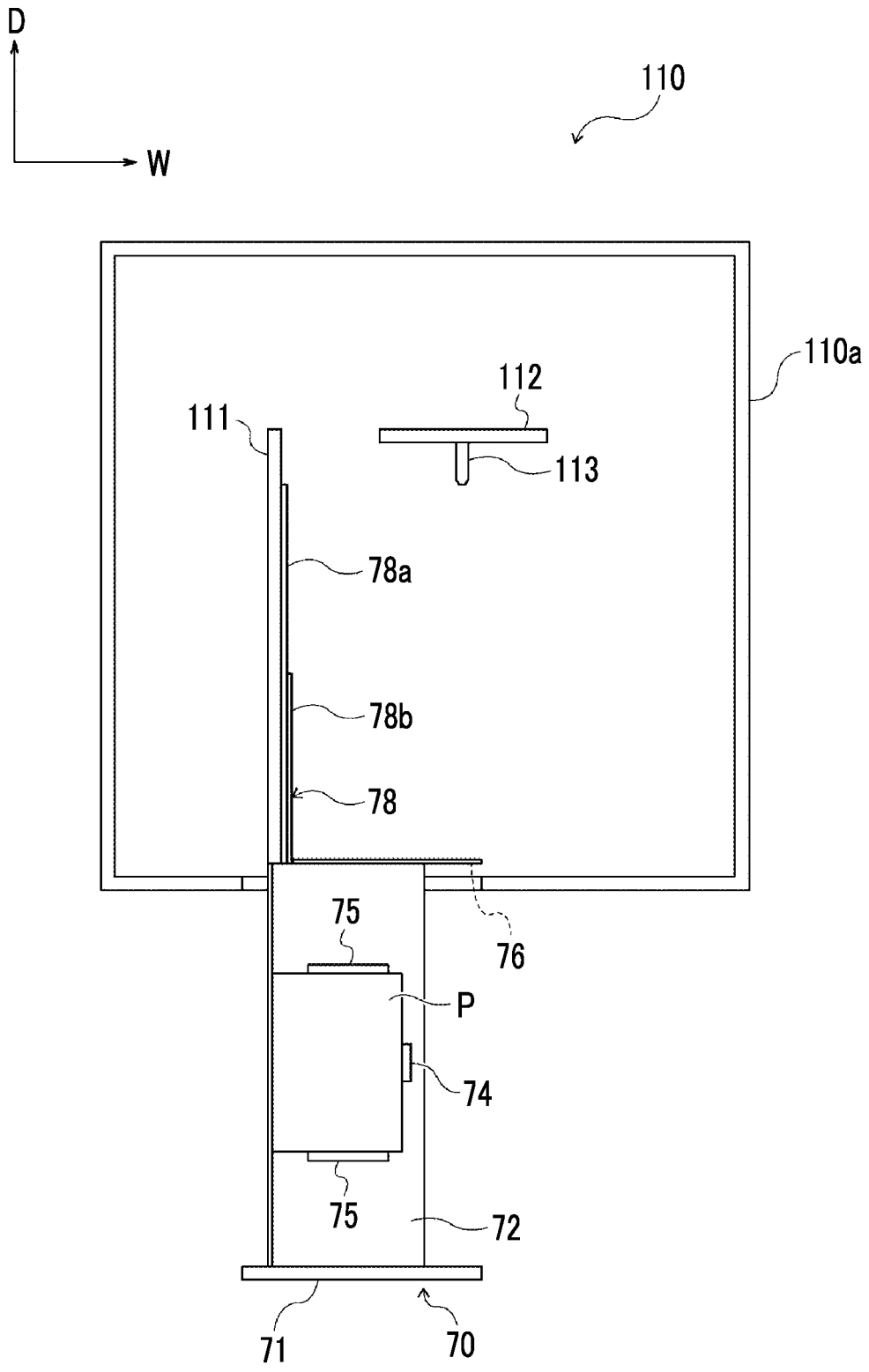
FIG. 6 is a schematic configuration view of the accommodating unit of the accommodating device according to the exemplary embodiment of the present invention and is a view showing a state where the accommodating unit is pulled out from the accommodating device.

By being pulled in the pulling direction B in a state of being mounted on the accommodating device 110 as shown in FIG. 5, the accommodating unit 70 comes into a state of being pulled out from the accommodating device 110 as shown in FIG. 6.

As shown in FIGS. 5 to 8, the accommodating unit 70 includes a front panel 71, a medium holding unit 72, a lower surface member 73, an adjusting member 74 for adjusting an accommodated size of the medium P in the apparatus width direction W, and two adjusting members 75 for adjusting an accommodated size of the medium P in the apparatus depth direction D.

The front panel 71 is a panel exposed to a front surface of the accommodating device 110 in a state where the accommodating unit 70 is mounted on the accommodating device 110 and is configured of, for example, a resin. The medium holding unit 72 is a member where the medium P is provided and is configured of, for example, a resin. A surface of the medium holding unit 72, on which the medium P is provided, is configured to be an upper surface 70*e* of the box-shaped accommodating unit 70. In addition, the medium holding unit 72 includes a moving mechanism (not shown) for moving the medium P upward and bringing the medium P into contact with the feeding roller 20*b* in a state where the accommodating unit 70 is mounted on the accommodating device 110.

Figure 7:
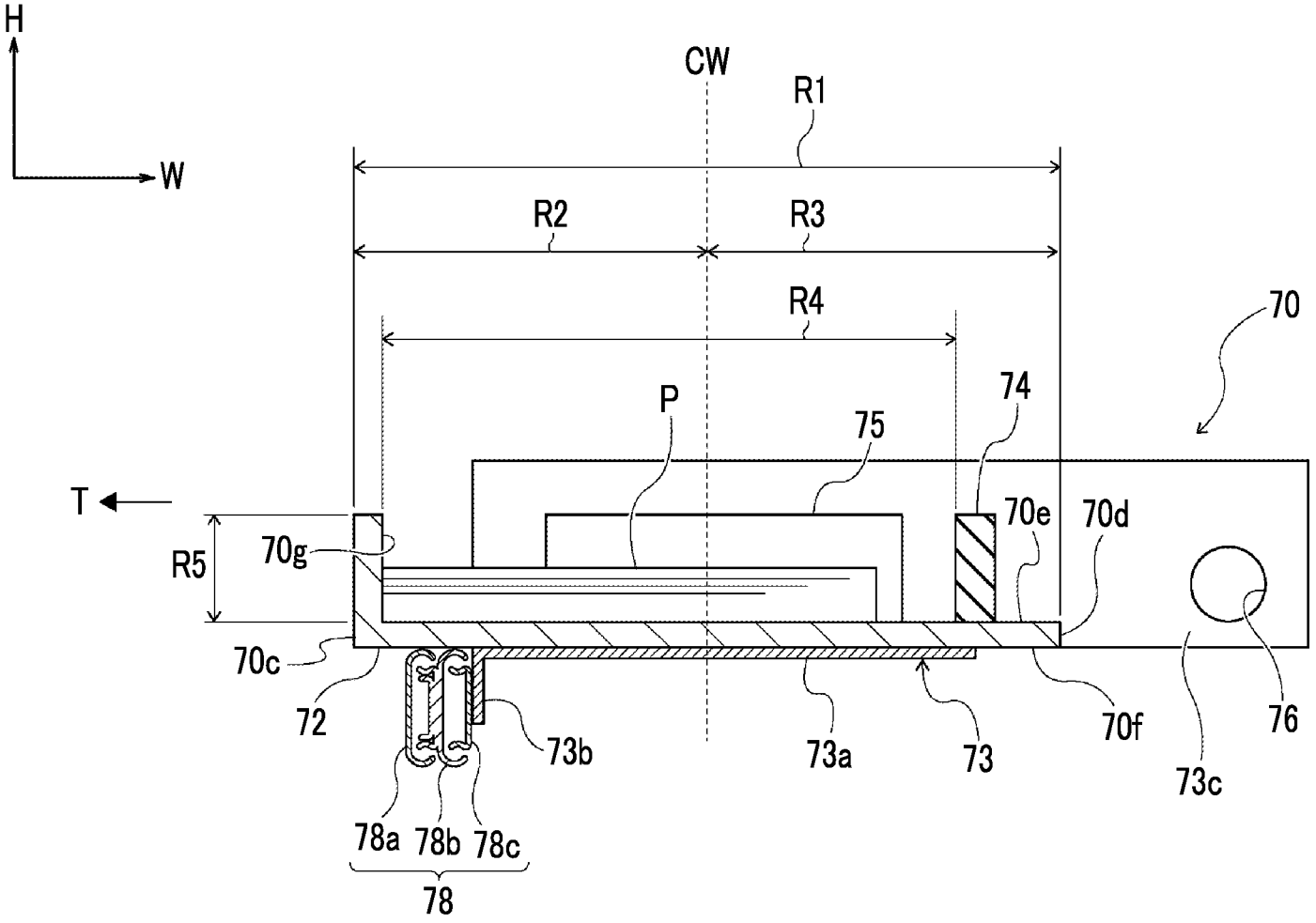
FIG. 7 is a cross-sectional view of the accommodating unit of the accommodating device according to the exemplary embodiment of the present invention and is a cross-sectional view taken along line A-A in FIG. 5.

As shown in FIG. 7, a main surface 73*a* of the lower surface member 73 is configured of a metal sheet forming at least a part of a lower surface 70*f* of the accommodating unit 70. The metal sheet configuring the lower surface member 73 is fixed to a lower surface of the medium holding unit 72. In the metal sheet configuring the lower surface member 73, a bent portion 73*b* obtained by bending a part of the main surface 73*a* downward is formed at a position on a slide rail 78 side with respect to a center CW of the accommodating unit 70 in the apparatus width direction W. The slide rail 78 is fixed to the accommodating unit 70 on an inner side with respect to side surfaces 70*c* and 70*d* in an intersecting direction (the apparatus width direction W in the present example) with the pulling direction B of the accommodating unit 70 in a horizontal plane and on a lower side in the vertical direction. The slide rail 78 will be described in detail later.

In the present exemplary embodiment, "the center CW of the accommodating unit 70 in the apparatus width direction W" means a center of a body portion accommodating the medium P in the apparatus width direction W, excluding a panel of a front surface 70*a* and a panel of a back surface 70*b* in the accommodating unit 70. Specifically, as shown in FIG. 7, the center CW is a center position of a region R1 between the side surfaces 70*c* and 70*d*, which is the width of the body portion of the accommodating unit 70 accommodating the medium P. In the present exemplary embodiment, the body portion of the accommodating unit 70 is configured by the medium holding unit 72. For this reason, the side surfaces 70*c* and 70*d* of the accommodating unit 70 in the apparatus width direction W are the same as both side surfaces of the medium holding unit 72 in the apparatus width direction W. However, in a case where another member is attached to the medium holding unit 72, an outermost position in the apparatus width direction W is a side surface, including the other member. Therefore, the position of "the center CW of the accommodating unit 70 in the apparatus width direction W" does not change depending on the shapes and sizes of the panel of the front surface 70*a* and the panel of the back surface 70*b* of the accommodating unit 70.

In addition, in the metal sheet configuring the lower surface member 73, a bent portion 73*c* obtained by bending a part of the main surface 73*a* upward is formed at a position on the back side in the apparatus depth direction D. The bent portion 73*c* functions as the panel of the back surface 70*b* of the accommodating unit 70. In addition, a hole 76 is formed in the bent portion 73*c*. The hole 76 will be described in detail later.

Figure 8:
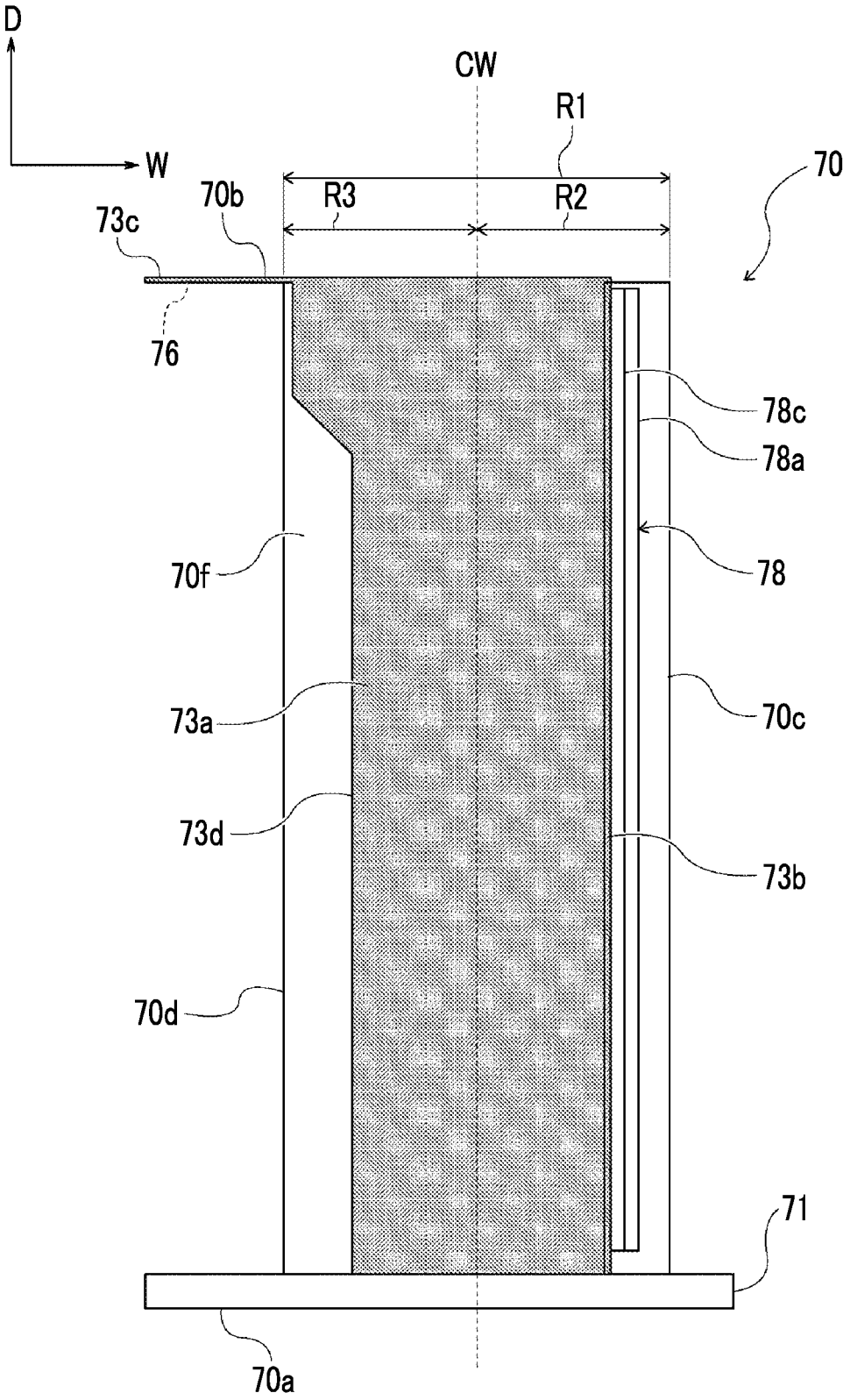
FIG. 8 is a bottom view of the accommodating unit of the accommodating device according to the exemplary embodiment of the present invention.

In addition, as shown in FIG. 8, in a region R3 on the opposite side to the slide rail 78 side with respect to the center CW of the accommodating unit 70 in the apparatus width direction W, at least a part of an end portion 73*d* of the metal sheet configuring the lower surface member 73 is configured to be on the inner side of the side surface 70*d* of the accommodating unit 70. Herein, the inner side of the side surface 70*d* of the accommodating unit 70 means an inner side of the side surface 70*d* that is an end portion of the region R1 which is the width of the body portion of the accommodating unit 70. In FIG. 8, a portion of the lower surface member 73 is shown with dots attached.

The adjusting member 74 is attached to the medium holding unit 72 so as to be movable in the apparatus width direction W. The two adjusting members 75 are attached to the medium holding unit 72 so as to be movable symmetrically in synchronization with a center position of an accommodation region of the medium P as reference in the apparatus depth direction D.

As shown in FIG. 7, the accommodating unit 70 is configured to accommodate the medium P by bringing the medium P into contact with an inner wall surface 70*g* on the slide rail 78 side with respect to the center CW of the accommodating unit 70 in the apparatus width direction W. The medium P is brought into contact with the feeding roller 20*b* by the moving mechanism (not shown) in a state where the accommodating unit 70 is mounted on the accommodating device 110, and is transported from the accommodating unit 70 along a transport direction T parallel to the apparatus width direction W.

In the present exemplary embodiment, the pulling direction B of the accommodating unit 70 and a side Pa of the medium P on a leading end side in the transport direction T are substantially parallel to each other. The side surface 70*c* of the accommodating unit 70 is a surface arranged along the side Pa of the medium P on the leading end side. The side surface 70*d* is a surface on an opposite side to the side surface 70*c* of the accommodating unit 70. In the present exemplary embodiment, the fact that the pulling direction B of the accommodating unit 70 and the side Pa of the medium P on the leading end side in the transport direction T are parallel to each other may mean that both are practically parallel to each other, and an angle difference between both directions is in a state of allowing an error of approximately ±5°.

As shown in FIG. 7, the slide rail 78 is fixed to the accommodating unit 70 on the inner side with respect to one side surface 70*c* of the accommodating unit 70 and the side surface 70*d* on the opposite side thereto in the intersecting direction (the apparatus width direction W in the present example) with the pulling direction B of the accommodating unit 70 in the horizontal plane and on the lower side of the accommodating unit 70 in the vertical direction. The slide rail 78 is an example of an expanding and contracting member that expands and contracts to connect the accommodating unit 70 to the device body 110*a* so as to be able to be pulled out.

The slide rail 78 includes an outer member 78*a*, an intermediate member 78*b*, and an inner member 78*c*, the outer member 78*a* is fixed to a slide rail fixing portion 111 in the device body 110*a*, and the inner member 78*c* is attached to the bent portion 73*b* of the metal sheet configuring the lower surface member 73 of the accommodating unit 70.

The slide rail 78 is fixed to a position shifted from the center CW of the accommodating unit 70 in the apparatus width direction, and the centroid position of the accommodating unit 70 is located in a region R2 on the slide rail 78 side with respect to the center in the apparatus width direction W.

The device body 110*a* includes a support portion 113 that supports the accommodating unit 70 in a state where the accommodating unit 70 is located in the device body 110*a*. The support portion 113 is formed, for example, in a form of a support pin extending in the apparatus depth direction D inside the device body 110*a*. The support portion 113 is fixed to an indicator pin fixing portion 112 in the device body 110*a*.

In addition, the hole 76 is formed in the bent portion 73*c* of the lower surface member 73 that functions as the panel of the back surface 70*b* of the accommodating unit 70. The hole 76 is a hole formed on the outer side of an accommodation range of the medium P in a surface orthogonal to the pulling direction B of the accommodating unit 70. In the present exemplary embodiment, the accommodation range of the medium P of the accommodating unit 70 is a region corresponding to both of an accommodation range R4 of the medium P in the apparatus width direction W and an accommodation range R5 of the medium P in the apparatus up-down direction H.

As shown in FIG. 5, in a state of being located in the device body 110*a*, the accommodating unit 70 is configured such that the support portion 113 is inserted into the hole 76 and the accommodating unit 70 is supported by the support portion 113. As shown in FIG. 6, in a state of being pulled out from the device body 110*a*, the accommodating unit 70 is configured such that the support portion 113 is removed from the hole 76 and the support of the accommodating unit 70 by the support portion 113 is released.

With the configuration, in a case where the user pulls out the accommodating unit 70 mounted on the device body 110*a* in the pulling direction B, that is, to the front side in the apparatus depth direction D, the accommodating unit 70 is guided by the slide rail 78 and is detached from the device body 110*a*. In addition, in a case where the user pushes in the accommodating unit 70 detached from the device body 110*a* to the back side in the apparatus depth direction D, the accommodating unit 70 is guided by the slide rail 78 and is mounted on the device body 110*a*.

In addition, as shown in FIG. 4, in a state of being mounted on the device body 110*a* and a state of being detached from the device body 110*a*, the accommodating unit 70 is horizontally arranged in a case of being viewed from the apparatus depth direction D. The fact that the accommodating unit 70 is horizontally arranged in the present exemplary embodiment may mean being arranged along the horizontal direction, and that is, for example, a state where the medium P accommodated in the accommodating unit 70 is allowed to be slightly inclined so as not to move due to the inclination.

Then, the accommodating unit 70 mounted on the device body 110*a* is located at the transport position where the accommodated medium P can be transported, and the accommodating unit 70 detached from the device body 110*a* is located at the supply position where the medium P can be supplied to the accommodating unit 70.

Accommodating Unit 80 and Slide Rail 88

As shown in FIG. 4, the accommodating unit 80 has a box shape of which an upper side is open and accommodates a medium in the device body 110*a*. The accommodating unit 80 is another accommodating unit in the technique of the present invention. A pair of slide rails 88 are attached to both ends of the accommodating unit 80 in the apparatus width direction W respectively.

The slide rail 88 includes an outer member, an intermediate member, and an inner member, the outer member is attached to the device body 110*a*, and the inner member is attached to the accommodating unit 80.

Accordingly, in a case where the user pulls out the accommodating unit 80 mounted on the device body 110*a* to the front side in the apparatus depth direction D, the accommodating unit 80 is guided by the slide rail 88 and is detached from the device body 110*a*. In addition, in a case where the user pushes in the accommodating unit 80 detached from the device body 110*a* to the back side in the apparatus depth direction D, the accommodating unit 80 is guided by the slide rail 88 and is mounted on the device body 110*a*.

In addition, in a state of being mounted on the device body 110*a* and a state of being detached from the device body 110*a*, the accommodating unit 80 is horizontally arranged in a case of being viewed from the apparatus depth direction D. The fact that the accommodating unit 80 is horizontally arranged in the present exemplary embodiment may mean being arranged along the horizontal direction, and that is, for example, a state where the medium P accommodated in the accommodating unit 80 is allowed to be slightly inclined so as not to move due to the inclination.

The accommodating unit 80 mounted on the device body 110*a* is located at the transport position where the accommodated medium P can be transported, and the accommodating unit 80 detached from the device body 110*a* is located at the supply position where the medium P can be supplied to the accommodating unit 80.

Overall Configuration of Accommodating Device 110

Figure 9:
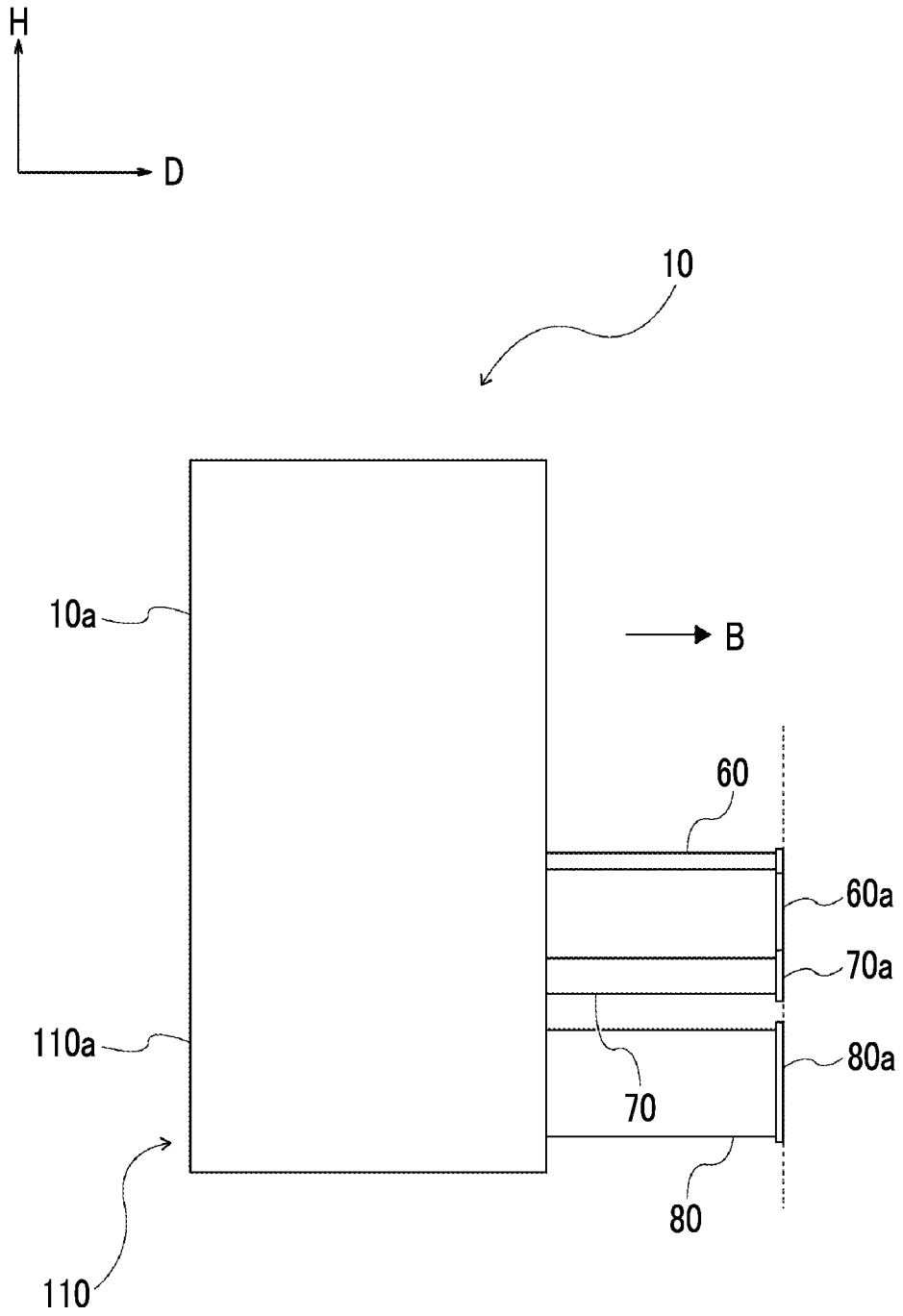
FIG. 9 is a side view showing a state where all of the accommodating units of the accommodating device according to the exemplary embodiment of the present invention are pulled out.

As described above, the accommodating device 110 includes, in addition to the accommodating unit 70 in the technique of the present invention, the other accommodating units 60 and 80 that can be pulled out in the same pulling direction B as in the accommodating unit 70. As shown in FIG. 9, all of front surfaces 60*a*, 70*a*, and 80*a* of the accommodating units 60, 70, and 80 are configured to be able to be pulled out to substantially the same position in the pulling direction B. The front surface of each accommodating unit is a front side surface of the accommodating unit, which faces the pulling direction B. In the present exemplary embodiment, the fact that all of the front surfaces 60*a*, 70*a*, and 80*a* of the accommodating units 60, 70, and 80 can be pulled out to substantially the same position in the pulling direction B may mean that the front surfaces 60*a*, 70*a*, and 80*a* can be practically pulled out to the same position, and that is, a state where a maximum error between the respective surfaces is allowed to be an error of approximately 1 cm, which is approximately the thickness of the front panel.

Operations of Accommodating Device 110 and Image Forming Apparatus 10

As described above, in the accommodating device 110, one slide rail 78 is fixed to the accommodating unit 70 on the inner side with respect to side surfaces 70*c* and 70*d* in the intersecting direction (the apparatus width direction W in the present example) with the pulling direction B of the accommodating unit 70 in the horizontal plane and on the lower side in the vertical direction. Accordingly, compared to a case where the slide rails are provided on both sides of the accommodating unit 70, a space where the accommodating unit 70 including the slide rail 78 is arranged is decreased.

In addition, the slide rail 78 is fixed to the position shifted from the center CW of the accommodating unit 70 in the apparatus width direction, and the centroid position of the accommodating unit 70 is located in the region R2 on the slide rail 78 side with respect to the center in the apparatus width direction W. Accordingly, compared to the centroid position of the accommodating unit 70 is located on the opposite side to the slide rail 78 with respect to the center CW, an increase in a load applied to the slide rail 78 is suppressed.

In addition, the bent portion 73*b* of the metal sheet configuring the lower surface member 73 having the main surface 73*a* forming at least a part of the lower surface 70*f* of the accommodating unit 70, which is obtained by bending a part of the main surface 73*a* downward, is formed at the position on the slide rail 78 side with respect to the center CW of the accommodating unit 70 in the apparatus width direction W. Accordingly, compared to a case where the bent portion is formed at the position on the opposite side to the slide rail 78 side with respect to the center CW of the accommodating unit 70 in the apparatus width direction W, the centroid of the accommodating unit 70 is brought closer to the slide rail 78 side.

In addition, on the opposite side to the slide rail 78 with respect to the center CW of the accommodating unit 70 in the apparatus width direction W, at least a part of the end portion 73*d* of the metal sheet configuring the lower surface member 73 is configured to be on the inner side of the side surface 70*d* of the accommodating unit 70. Accordingly, compared to a case where the entire end portion 73*d* of the metal sheet in the apparatus width direction W is configured to match the side surface 70*d* of the accommodating unit 70, the centroid of the accommodating unit 70 is brought closer to the slide rail 78 side.

In addition, the accommodating unit 70 is configured to accommodate the medium P by bringing the medium P into contact with the inner wall surface 70*g* on the slide rail 78 side with respect to the center CW of the accommodating unit 70 in the apparatus width direction W. Accordingly, compared to a case where the medium P is accommodated to be brought closer to the opposite side to the slide rail 78 side with respect to the center CW of the accommodating unit 70 in the apparatus width direction W, an increase in a load applied to the slide rail 78 is suppressed in a state where the medium P is accommodated in the accommodating unit 70.

In addition, the device body 110*a* includes the support portion 113 that supports the accommodating unit 70 in a state where the accommodating unit 70 is located in the device body 110*a*. Accordingly, since the accommodating unit 70 is shared and held by the slide rail 78 and the support portion 113 in a state where the accommodating unit 70 is located in the device body 110*a*, an increase in a load applied to the slide rail 78 is suppressed compared to a case where the accommodating unit 70 is supported only by the slide rail 78 with respect to the device body 110*a*.

In addition, the support pin extending in the pulling direction B is formed as the support portion 113 inside the device body 110*a*, the hole 76 is formed in the panel of the back surface 70*b*, which is the surface orthogonal to the pulling direction B of the accommodating unit 70, the support pin, which is the support portion 113, is inserted into the hole 76 in a state where the accommodating unit 70 is located in the device body 110*a*, and the accommodating unit 70 is configured to be supported by the support pin. Accordingly, with a simple configuration, an increase in a load applied to the slide rail 78 is suppressed in a state where the accommodating unit 70 is located in the device body 110*a*.

In addition, the hole 76 is a hole formed on the outer side of the accommodation range of the medium P in the surface orthogonal to the pulling direction B of the accommodating unit 70. Accordingly, in a state where the accommodating unit 70 is located in the device body 110*a*, the support pin, which is the support portion 113, is prevented from coming into contact with the medium P.

In addition, the accommodating device 110 includes, in addition to the accommodating unit 70 in the technique of the present invention, the other accommodating units 60 and 80 that can be pulled out in the same pulling direction B as in the accommodating unit 70. All of the front surfaces 60*a*, 70*a*, and 80*a* of the accommodating units 60, 70, and 80 are configured to be able to be pulled out to substantially the same position in the pulling direction B. Accordingly, in a case of including a plurality of accommodating units, beauty of the apparatus appearance and safety in a state where all of the accommodating units are pulled out are improved compared to a case where the front surfaces of the accommodating units are at positions different from each other in a state where all of the accommodating units are pulled out.

In addition, compared to a case where the accommodating device 110 is not included in the image forming apparatus 10, a range necessary in a case of supplying the medium P to the image forming apparatus 10 is decreased.

Although details of a certain exemplary embodiment of the present invention have been described, the present invention is not limited to such an exemplary embodiment, and it is clear for those skilled in the art that the present invention can take other various exemplary embodiments within the scope of the present invention.

For example, although the accommodating device 110 is used in the image forming apparatus 10 adopting the electrophotographic method in the exemplary embodiment, for example, the accommodating device 110 may be used in an image forming apparatus adopting an inkjet method. In addition, the accommodating device is not limited to being applied to the image forming apparatus and may be applied to an optional device such as a paper feeding device.

In addition, an arrangement position, an arrangement inclination state, a shape, a size, and a maximum pulling amount with respect to the device body 110*a* of the accommodating device 110 of each of the accommodating unit 60, the accommodating unit 70, and the accommodating unit 80 are not limited to the exemplary embodiment. In addition, although the accommodating device 110 includes the accommodating unit 60, the accommodating unit 70, and the accommodating unit 80 in the exemplary embodiment, the accommodating unit 60 and the accommodating unit 80 may not be included. In this case, operations achieved by including the accommodating unit 60 and the accommodating unit 80 cannot be achieved.

In addition, the accommodating device 110 may be provided with an openable and closable cover covering the accommodating unit 60, the accommodating unit 70, and the accommodating unit 80.

In addition, the slide rail 78 is not limited to being configured by three members including the outer member 78*a* attached to the device body 110*a* of the accommodating device 110, the intermediate member 78*b*, and the inner member 78*c* attached to the accommodating unit 70, and other forms may be adopted. For example, the slide rail 78 may be configured by two members including a guide member attached to the device body 110*a* of the accommodating device 110 and a guided member attached to the accommodating unit 70. In addition, a member of the slide rail 78, which is attached to the device body 110*a* of the accommodating device 110, may be configured to be integrated with the device body 110*a*. Similarly, a member of the slide rail 78, which is attached to the accommodating unit 70, may be configured to be integrated with the accommodating unit 70. In addition, the expanding and contracting member is not limited to the slide rail and may be another mechanism such as an air cylinder.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An accommodating device comprising:

a device body;

an accommodating unit that accommodates a medium in the device body; and an expanding and contracting member that expands and contracts to connect the accommodating unit to the device body so as to be pulled out and has a part fixed to the accommodating unit on an inner side with respect to a side surface of the accommodating unit in an intersecting direction with a pulling direction of the accommodating unit and on a lower side of the accommodating unit in a vertical direction.

2. The accommodating device according to claim 1, wherein the expanding and contracting member is fixed at a position shifted from a center of the accommodating unit in the intersecting direction, and a centroid position of the accommodating unit is located on an expanding and contracting member side with respect to the center in the intersecting direction.

3. The accommodating device according to claim 2, wherein a bent portion of a metal sheet having a main surface forming at least a part of a lower surface of the accommodating unit, which is obtained by bending a part of the main surface downward, is formed at a position on the expanding and contracting member side with respect to the center of the accommodating unit in the intersecting direction, and the expanding and contracting member is fixed to the bent portion.

4. The accommodating device according to claim 3, wherein on an opposite side to the expanding and contracting member side with respect to the center of the accommodating unit in the intersecting direction, at least a part of an end portion of the metal sheet is located on the inner side of the side surface of the accommodating unit.

5. The accommodating device according to claim 2, wherein the accommodating unit is configured to accommodate the medium by bringing the medium into contact with an inner wall surface on the expanding and contracting member side with respect to the center of the accommodating unit in the intersecting direction.

6. The accommodating device according to claim 3, wherein the accommodating unit is configured to accommodate the medium by bringing the medium into contact with an inner wall surface on the expanding and contracting member side with respect to the center of the accommodating unit in the intersecting direction.

7. The accommodating device according to claim 4, wherein the accommodating unit is configured to accommodate the medium by bringing the medium into contact with an inner wall surface on the expanding and contracting member side with respect to the center of the accommodating unit in the intersecting direction.

8. The accommodating device according to claim 1, wherein the device body includes a support portion that supports the accommodating unit in a state where the accommodating unit is located in the device body.

9. The accommodating device according to claim 2, wherein the device body includes a support portion that supports the accommodating unit in a state where the accommodating unit is located in the device body.

10. The accommodating device according to claim 3, wherein the device body includes a support portion that supports the accommodating unit in a state where the accommodating unit is located in the device body.

11. The accommodating device according to claim 4, wherein the device body includes a support portion that supports the accommodating unit in a state where the accommodating unit is located in the device body.

12. The accommodating device according to claim 5, wherein the device body includes a support portion that supports the accommodating unit in a state where the accommodating unit is located in the device body.

13. The accommodating device according to claim 6, wherein the device body includes a support portion that supports the accommodating unit in a state where the accommodating unit is located in the device body.

14. The accommodating device according to claim 7, wherein the device body includes a support portion that supports the accommodating unit in a state where the accommodating unit is located in the device body.

15. The accommodating device according to claim 8, wherein a support pin extending in the pulling direction is formed as the support portion inside the device body, a hole is formed in a surface orthogonal to the pulling direction of the accommodating unit, and in a state where the accommodating unit is located in the device body, the support pin is inserted into the hole, and the accommodating unit is supported by the support pin.

16. The accommodating device according to claim 9, wherein a support pin extending in the pulling direction is formed as the support portion inside the device body, a hole is formed in a surface orthogonal to the pulling direction of the accommodating unit, and in a state where the accommodating unit is located in the device body, the support pin is inserted into the hole, and the accommodating unit is supported by the support pin.

17. The accommodating device according to claim 10, wherein a support pin extending in the pulling direction is formed as the support portion inside the device body, a hole is formed in a surface orthogonal to the pulling direction of the accommodating unit, and in a state where the accommodating unit is located in the device body, the support pin is inserted into the hole, and the accommodating unit is supported by the support pin.

18. The accommodating device according to claim 15, wherein the hole is formed on an outer side of an accommodation range of the medium in the surface orthogonal to the pulling direction of the accommodating unit.

19. The accommodating device according to claim 1, further comprising:

at least one or more other accommodating units that are able to be pulled out from the device body in the pulling direction and are different from the accommodating unit, wherein front side surfaces of all of the accommodating units in the pulling direction are configured to be pulled out to substantially the same position in the pulling direction.

20. An image forming apparatus comprising:

the accommodating device according to claim 1; and an image forming unit that forms an image on a medium, which is accommodated in the accommodating device and is transported.

* * * * *